United States Patent [19]

Jäger et al.

[11] 4,394,227

[45] Jul. 19, 1983

[54] ELECTROCHEMICAL PROCESS FOR THE PREPARATION OF BENZANTHRONES AND PLANAR, POLYCYCLIC AROMATIC OXYGEN-CONTAINING COMPOUNDS

[75] Inventors: Horst Jäger, Bettingen; Eric Plattner, Seltisberg; Jacques Bersier, Riehen; Christos Comninellis, Prilly, all of Switzerland

[73] Assignee: Ciba-Geigy AG, Basel, Switzerland

[21] Appl. No.: 354,109

[22] Filed: Mar. 2, 1982

[30] Foreign Application Priority Data

Mar. 5, 1981 [CH] Switzerland ..... 1475/81
May 8, 1981 [CH] Switzerland ..... 2996/81

[51] Int. Cl.[3] ..... C25B 3/04
[52] U.S. Cl. ..... 204/73 R; 260/352; 260/355; 260/364
[58] Field of Search ..... 204/73 R, 72; 260/352, 260/364, 355

[56] References Cited

U.S. PATENT DOCUMENTS 4,311,565 1/1982 Bersier et al. ..... 204/73 R

*Primary Examiner*—R. L. Andrews
*Attorney, Agent, or Firm*—Joseph G. Kolodny

[57] ABSTRACT

An electrochemical process for the preparation of benzanthrones and planar, polycyclic aromatic oxygen-containing compounds is described. The process is carried out in an acid medium in an electrolytic cell which is separated by a diaphragm into a cathode compartment and an anode compartment.

In the cathode compartment, anthraquinone or an anthraquinone derivative is reduced electrolytically to oxanthrone and the latter is reacted with glycerol to give the corresponding benzanthrone.

In the anode compartment, a transition metal ion is simultaneously converted electrolytically from a lower oxidation stage into the next higher oxidation stage. The metal ion of higher valency is then used in the anolyte as an oxidizing agent by means of which the corresponding oxygen-containing compounds are obtained, starting from planar, polycyclic aromatic compounds.

22 Claims, No Drawings

ELECTROCHEMICAL PROCESS FOR THE PREPARATION OF BENZANTHRONES AND PLANAR, POLYCYCLIC AROMATIC OXYGEN-CONTAINING COMPOUNDS

The present invention relates to an electrochemical redox process which is carried out in an electrolytic cell separated by a diaphragm into a cathode compartment and an anode compartment, benzanthrones being produced cathodically and planar, polycyclic aromatic oxygen-containing compounds being produced at the same time anodically.

The oxygen-containing compounds which can be obtained in accordance with the present invention have hitherto frequently been prepared by means of reduction or oxidation reactions in which, on a large industrial scale, polyvalent heavy metals or heavy metal salts are often used as reducing agents or oxidising agents. Working up thus leaves, as a residue, dilute solutions of metal salts, the disposal of which as waste presents considerable ecological problems.

Thus, for example, metals such as iron, zinc, aluminum or copper in concentrated sulfuric acid are used to convert anthraquinone by reduction into the semiquinone form. Processes of this type are described, inter alia, in U.S. Pat. No. 1,896,147 (reducing agent Fe), U.S. Pat. No. 2,034,485 and U.S.S.R. Pat. No. 401,130 (reducing agents Fe and Cu), A. M. Lahin. Zhur. Obschei Khim. 18, 308 (1948), see CA 44, 1079b (reducing agents Zn, Al and $CuSO_4$) and U.S. Pat. No. 1,791,309 (reducing agents Zn and Al). Of these, iron has acquired the greatest importance in practice as a reducing agent. However, the use of iron as the reducing agent entails considerable economic and ecological disadvantages, since at least 2 mols of iron must be employed per mol of anthraquinone. The result of this is that, for example, 2.0 mols of iron sulfate are produced as a waste product per mole of benzanthrone prepared, or at least 1,320 g of iron sulfate for every 1,000 g of benzanthrone prepared. In addition, large quantities of waste sulfuric acid are produced, since isolation of the benzanthrone formed requires the sulfuric acid to be diluted to approx. 20%, and this acid must then either be regenerated with the outlay of energy to give concentrated sulfuric acid, or its removal also constitutes an environmental problem.

The oxidation of polycyclic aromatic compounds has hitherto often been carried out by means of polyvalent metal salts in an acid medium. When the reaction is complete, the organic oxidation product is separated, in this process, from the reduced metal salt by diluting the reaction solution considerably with water and filtering off the organic product or extracting it with a solvent, and here too the removal of the waste acid together with the dissolved metal salt presents considerable ecological problems.

Thus, for example, 1,200 kg of $MnSO_4$ in approx. 30,000 kg of 10% sulfuric acid are formed in the preparation of 500 kg of dihydroxyviolanthrone. It is not economic to work up this mixture, so that there is no option but to convert the sulfuric acid into calcium sulfate and to dump the latter.

Carrying out the reaction electrochemically, which pollutes the environment very little, is one alternative to the use of reducing agents or oxidising agents which pollute the environment.

Thus, for example, the following electrochemical process for the preparation of benzanthrone, starting from anthraquinone and glycerol, is disclosed in European Patent Application No. 22,062. Anthraquinone is reduced cathodically in an electrolytic cell in an acid medium and is thus converted into the semiquinone form, oxanthrone, which reacts with glycerol to form benzanthrone by cyclisation.

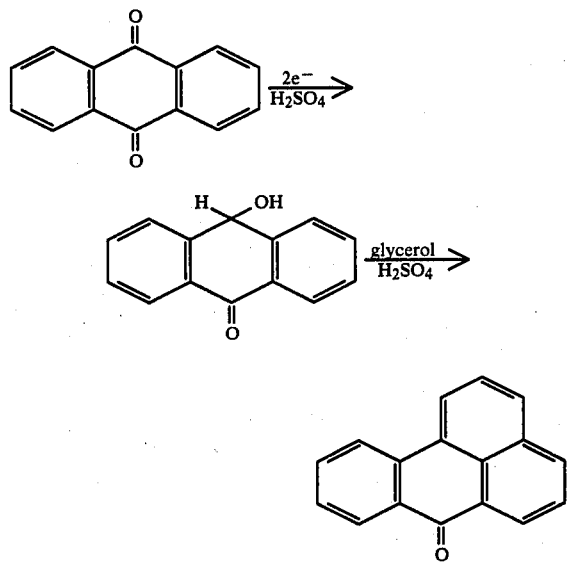

However, use is not made in this process of the oxidation potential of the anode.

The object of the invention is thus to develop an electrochemical redox process which combines the previously known reduction reaction which takes place cathodically, with an oxidation reaction which takes place simultaneously anodically.

An electrochemical process for the preparation of benzidine from azoxybenzene and of anthraquinone from anthracene is known from U.S. Pat. No. 1,544,357. In this process, azoxybenzene is converted into the product mentioned cathodically and anthracene is converted into the product mentioned anodically. Both reactions take place at the same time in the electrolytic cell, which is separated by a diaphragm into a cathode compartment and an anode compartment. The electrolytic cell contains sulfuric acid, in which a Cr(III) salt is dissolved on the cathode side and a Cr(III) or Cr(VI) salt is dissolved on the anode side.

Although this known electrochemical process relates to carrying out a cathodic reduction and an anodic oxidation simultaneously, it cannot be used as a means of solving the present problem, since it has been found that the synthesis of benzanthrone is inhibited by Cr(III) ions. Furthermore, if sulfuric acid at a concentration exceeding 75% is used as the anolyte, it has not been possible to repeat the oxidation, described in the U.S. Patent, of Cr(III) to Cr(VI).

It has been found, surprisingly, that benzanthrone is obtained on the cathode side and polycyclic aromatic oxygen-containing compounds, such as dioxoviolanthrone, are obtained on the anode side, even without using metal salts in the cathode compartment. This means that, while simultaneously using the electrochemical potential of the anode as well as the cathode, it is possible in the present case to dispense with the use of metal ions in the cathode compartment. Furthermore, ions of transition metals, for example ions of the elements manganese, cerium or cobalt, have proved suitable on the anode side.

The process according to the invention thus consists in preparing benzanthrones and polycyclic, planar aromatic oxygen-containing compounds simultaneously by electrochemical means, by carrying out the reaction in an electrolytic cell which is separated by a diaphragm into a cathode compartment and an anode compartment and which contains an acid, an anthraquinone of the formula

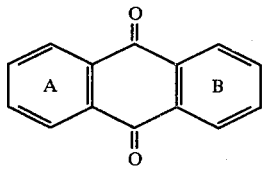

being converted electrochemically in the cathode compartment into the semiquinone form and the latter being reacted with glycerol to give benzanthrone of the formula

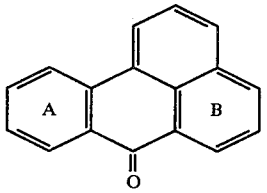

in which the benzene rings A and B can be substituted, and, simultaneously, the cations of a transition metal salt being converted in the anode compartment from the lower oxidation stage into a higher stage and these metal ions being used for the chemical oxidation of planar, polycyclic aromatic compounds to give the corresponding oxygen-containing compounds. When the electrolysis is complete, the products are isolated from the catholyte and the anolyte.

The starting material used for the preparation, effected in the cathode compartment, of benzanthrones, which are of significance as important vat dye intermediates, is preferably unsubstituted anthraquinone, but, in addition, it is also possible to use anthraquinones in which the rings A and B contain one or more of the following substituents: $C_1$–$C_4$ alkyl, for example the methyl or ethyl group, and also $C_1$–$C_4$ alkoxy, such as methoxy, ethoxy, n-propoxy and isopropoxy radical and the n-, iso- and tert.-butoxy radical; finally, other possible substituents are the hydroxyl group and the halogen atoms, such as chlorine, bromine and iodine.

Examples of polycyclic, planar aromatic compounds which are converted into the corresponding oxygen-containing compounds in the anode compartment in accordance with the present invention, are those of the anthraquinone, benzanthrone and pyrene series. Starting compounds of this type can also contain, for example, alkyl side chains, which are oxidised terminally to give the aldehyde or the acid.

The conversion of 4,4'-bibenzanthrone into dioxoviolanthrone is mentioned as an example of the chemical oxidation reaction in the anode compartment.

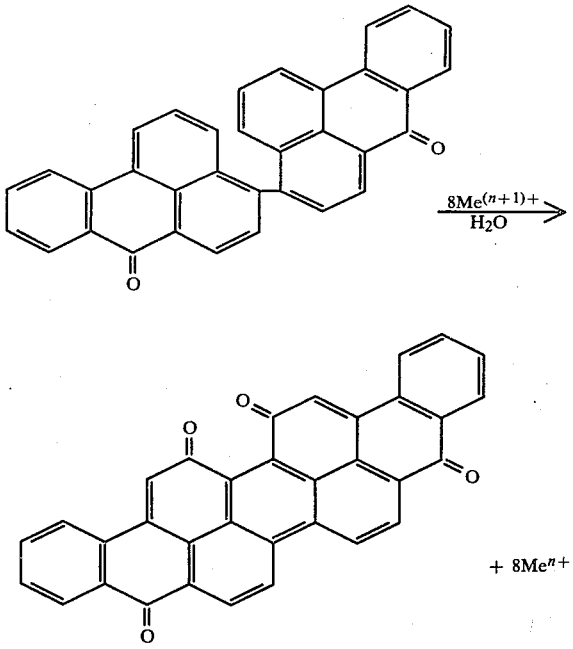

Dioxoviolanthrone can be reduced readily to give dihydroxyviolanthrone, an important intermediate for the synthesis of vat dyes. For recycling the anolyte it is advantageous in this case to carry out the reduction of dioxoviolanthrone to dihydroxyviolanthrone with $SO_2$ gas.

It is surprising that these large, sparingly soluble aromatic molecules, such as 4,4'-bibenzanthrone or violanthrone, can be oxidised readily by the novel process. In this process, the oxidation can either be carried out direct in the anode compartment using a quantity of the metal salt less than that required by stoichiometry, or can preferably be carried out separately from the anode compartment using, as the oxidising agent, an anolyte solution which contains more than the stoichiometric quantity of metal salt.

The electrolytic cell selected can be any cell having a diaphragm, which should be resistant to acids, both concentrated and dilute mineral acids, for example sulfuric acid or phosphoric acid, and organic acids, for example acetic acid. Examples of materials of which the diaphragm is composed are glass, clay, porous polytetrafluoroethylene or polymeric, perfluorinated hydrocarbons in the form of an ion exchange membrane. The pore size of the diaphragm is within the range from 1 to 300$\mu$.

The reaction in the cathode compartment can be carried out under an atmosphere of protective gas so that no oxidative counter-reaction takes place. It is sufficient for this purpose if the reaction vessel is swept with a slight stream of gas above the level of the liquid, for example with nitrogen.

The materials which are customary for electrochemical reactions, such as, say, metals, metal alloys, activated metals, metal oxide electrodes, carbon electrodes or electrodes made of vitreous sintered carbon, are suitable for the cathode.

Platinum, electrodes made of vitreous sintered carbon and $PbO_2$ on titanium are suitable for the anode.

The last of these is particularly for in situ reactions in the anode compartment.

Mineral acids having a $pK_s<2$, for example sulfuric or phosphoric acid, are particularly suitable as the acid reaction medium. Sulfuric acid of a concentration of 60 to 98% and, particularly, of a concentration of 80 to 95%, is particularly suitable.

In addition to the acid, the electrolyte can also contain, as a solubiliser, organic solvents which are inert to the reaction.

The electrochemical synthesis is effected at a temperature between 50° and 150° C. Owing, however, to the solubility or capacity for suspension in the electrolyte, containing for example sulfuric acid, of the quinoid compounds formed as intermediates, it is necessary to select operating temperatures within the range from about 80° to 120° C., and particularly 90° to 105° C., in order to be able to carry out the reaction at concentrations which are of interest from a technical point of view.

The oxidation of planar polycyclic aromatic compounds to give the corresponding hydroxy compounds is effected in the anolyte by means of transition metal ions having an oxidation potential of at least +0.5 volt in an acid solution. The metal ions which are thus used as the oxidising agents are produced in the anode compartment by electrolytic means in accordance with the following equation:

$$Me^{n+} - xe^- \rightarrow Me^{(n+x)+}$$

Me = metal ion n+x = charge number, x being 1 to 5, but preferably 1, $e^-$ = an electron, i.e. metal ions are converted at the anode from a lower to a higher oxidation stage.

Transition metal redox pairs having an oxidation potential between +0.5 and +2.5 volts are particularly suitable; the following are mentioned individually: $Mn^{2+}/Mn^{3+}$ +1.51 volts; $Ce^{3+}/Ce^{4+}$ +1.44 volts; $Co^{2+}/Co^{3+}$ +1.842 volts (in 3 N $HNO_3$); and $Ag^{+}/Ag^{2+}$ +1.987 volts (in 4 N $HClO_4$); as measured against a standard hydrogen electrode.

It is also possible for a mixture of two redox pairs to be present in the anode compartment, one of the two being present in each case in catalytic quantities, specifically using molar ratios of 1:100 to 1:1,000. It is preferable to use mixtures of redox pairs in which the component employed at the lower concentration, specifically 1 to 10 mmols per mol of transition metal sulfate, is a silver(I) salt, for example silver(I)sulfate, which during the reaction is oxidised to silver(II)sulfate at the anode. The addition of catalytic quantities of silver salts increases the yield in the conversion of the transition metal salt into its higher valency stage. Thus, in the case of the oxidation of manganese(II) to manganese(III), the yield of manganese(III) can be increased by 20 to 50%, depending on the current density.

The transition metal ions of higher valency which have been produced electrochemically react in situ with the planar, polycyclic aromatic compound dissolved in the anolyte and oxidise the latter to give the corresponding oxygen-containing compounds, being themselves thereby reconverted into the lower valency stage by taking up electrons, and are finally re-oxidised anodically and once more become available as an oxidising agent. In this way, the oxidising agent is recycled and a quantity less than that required by stoichiometry is therefore sufficient to oxidise the organic starting compound in the anode compartment.

In a preferred embodiment of the process according to the invention, the anode compartment does not contain an organic compound in addition to the metal salt or mixture of salts when current is passed through. In this case the electrolysis is discontinued when the metal salt or the main component of the mixture of salts has been almost completely converted into the higher valency stage. This salt solution or suspension can now be withdrawn from the anode compartment and employed to oxidise planar, polycyclic aromatic compounds in a separate reaction vessel. Since there is no regeneration of spent oxidising agent in this case, stoichiometric proportions between the oxidising agent and the aromatic compound must be maintained.

After removing the aromatic oxygen-containing compound, the spent oxidising agent at the end of the chemical oxidation reaction, that is to say the solution of the metal salt, which is now in the lower oxidation stage, can be recycled to the anode compartment, if appropriate after clarification by means of active charcoal and reconcentration, and is re-oxidised again in the anode compartment by electrolysis.

The products obtained can be isolated from the catholyte or anolyte in a conventional manner. If sulfuric acid is used as the reaction medium, the latter is diluted, for example to 60%, and the product which has been precipitated is filtered off and washed until it is neutral, or the product is extracted from the 60% sulfuric acid by means of a commercially available solvent.

After the product has been isolated, the anolyte is re-concentrated to its original concentration and is employed in the next oxidation cycle.

However, it is also possible to carry out reoxidation in the dilute solution and the re-oxidised anolyte can then be brought to its original concentration.

Higher-boiling, inert organic solvents, particularly halogenated hydrocarbons, especially chlorobenzenes, for example monochlorobenzene, are suitable for the isolation process carried out by extracting the reaction product which has been formed and separating the phases.

The temperature of extraction (dissolving the product in the organic solvent) is 70° to 110° C., advantageously 90° to 100° C.

The following are the most important advantages of the process according to the invention:

(a) The cathode and also the anode compartment are used for carrying out redox reactions simultaneously, (b) A high oxidation yield in the reaction $Me^{n+} \rightarrow Me^{(n+x)+}$ is achieved by using mixtures of transition metal salts in the anode compartment, and (c) After isolating the aromatic oxidation product, the anolyte can be re-used, if appropriate after purification and re-concentration, and thus does not cause any ecological problems.

The invention is illustrated by means of the following examples.

EXAMPLE 1

46.8 g (0.225 mol) of anthraquinone are dissolved in 1,300 g of 88% sulfuric acid on the cathode side in an electrolytic apparatus equipped with a carbon cathode, a Pt anode and a clay diaphragm, and 31.05 g of glycerol are added dropwise during the electrolysis.

The anode side of the electrolytic cell contains 130 g of 88% sulfuric acid, in which 10 g (0.059 mol) of $MnSO_4.H_2O$ are suspended. 51,700 coulombs are consumed in the electrolysis at 95° C. (3.5 volts, 3 amperes and 5 hours).

44.0 g of benzanthrone of melting point 171°–173° C. are isolated after the crude benzanthrone has been precipitated from the catholyte and sublimed. This corresponds to a yield of 85% of theory, at a cathodic current efficiency of 71.4%.

When the electrolysis is complete, the anolyte is run into a beaker and treated with 10.0 g (0.021 mol) of 4,4'-bibenzanthrone and the reaction mixture is stirred for 4 hours at 30° C. The dioxoviolanthrone formed is reduced to dihydroxyviolanthrone in situ by adding 400 ml of 40% sodium bisulfite solution dropwise. The precipitate of dihydroxyviolanthrone is finally filtered off, washed and dried.

Yield of dihydroxyviolanthrone: 11.0 g=76.4% of theory.

Dihydroxyviolanthrone is used as an intermediate for the synthesis of the vat dye of the formula

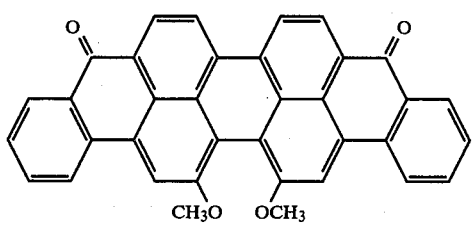

which is obtained by methylating dihydroxyviolanthrone.

The yield in this process is approx. 99.5%, if electrochemically prepared dihydroxyviolanthrone is employed.

EXAMPLES 2 TO 5

In the examples which follow, the following substituted anthraquinones, in place of anthraquinone, are first converted electrochemically, as described in Example 1 and in the same electrolytic cell, into the semiquinone form, which reacts in situ with glycerol to give the corresponding substituted benzanthrone.

| Example | Starting compound quantity in mols | Glycerol | $H_2SO_4$ | Coulombs | Temperature | Yield | Compounds obtained |
|---|---|---|---|---|---|---|---|
| 2 | 1-Methoxyanthraquinone 0.05 | 0.1 mol | 150 ml 96% | 28,000 | 90° C. | 70% | 6-Hydroxybenzanthrone 16.0% 6-Methoxybenzanthrone 79.3% |
| 3 | 1,2-Dihydroxyanthraquinone 0.025 | 0.05 mol | 200 ml 85% | 7,200 | 95° C. | 30% | 5,6-Dihydroxybenzanthrone 70% 1,2-Dihydroxyanthraquinone recovered |
| 4 | 2-Hydroxyanthraquinone 0.025 | 0.05 mol | 150 ml 85% | 8,800 | 95° C. | 66% | 4-Hydroxybenzanthrone |
| 5 | 1-Chloroanthraquinone 0.15 | 0.5 mol | 500 ml 85% | 60,000 | 85° C. | 29.5% | 6-Chlorobenzanthrone 86.1% 6-Hydroxybenzanthrone 13.6% |

EXAMPLE 6

46.8 g (0.225 mol) of anthraquinone are dissolved in 1,300 g of 88% sulfuric acid on the cathode side in an electrolytic apparatus equipped with a carbon cathode, an anode made of vitreous sintered carbon and a clay diaphragm, and 31.05 g of glycerol are added dropwise while current is being passed.

The anode side of the electrolytic cell also contains 1,300 g of 88% sulfuric acid, in which 100 g (0.59 mol) of $MnSO_4.H_2O$ are suspended. 51,600 coulombs are consumed in the electrolysis at 95° C. (3.5 volts, 3 amperes and 5 hours).

37.08 g of benzanthrone, of melting point 171°–173° C., are isolated after the crude benzanthrone has been precipitated from the catholyte and sublimed. This corresponds to a yield of 71.6% of theory, at a cathodic current efficiency of 60%.

When the electrolysis is complete, the anolyte is used to oxidise 4,4'-dibenzanthrone as described in Example 1.

EXAMPLES 7 TO 13

The reaction is carried out as described in Example 6, except that the anthraquinone/glycerol ratio in the catholyte is varied and the pair of cations on the anode side is varied and the anode used is a platinum electrode, thus giving the following results in respect of the benzanthrone yield:

| Example | Anthraquinone:glycerol (mols) | Redox pair | Yield of benzanthrone after sublimatation |
|---|---|---|---|
| 7 | 1:2 | $Ce^{3+}/Ce^{4+}$ | 83% melting point 173° C. |
| 8 | 1:2 | $Ce^{3+}/Ce^{4+}$ | 85% melting point 171° C. |
| 9 | 1:1.5 | $Mn^{2+}/Mn^{3+}$ | 83% melting point 172° C. |
| 10 | 1:1.25 | $Mn^{2+}/Mn^{3+}$ | 87% melting point 173° C. |
| 11 | 1:1.1 | $Mn^{2+}/Mn^{3+}$ | 71% melting point 173° C. |
| 12 | 1:1.5 $H_2SO_4$ 1× recycled | $Mn^{2+}/Mn^{3+}$ | 83% melting point 173° C. |
| 13 | 1:1.5 $H_2SO_4$ 2× recycled | $Mn^{2+}/Mn^{3+}$ | 83% melting point 173° C. |

EXAMPLE 14

A $Ti/PbO_2$ anode is used instead of a Pt anode in the electrolytic apparatus described in Example 1. The clay diaphragm is replaced by an ion exchange membrane composed of perfluorinated polymeric hydrocarbons. The cathodic and anodic reactions take place simultaneously.

The cathodic synthesis of benzanthrone proceeds as described in Example 5. The yield of sublimed benzanthrone is 83.5% of theory, melting point 170°-172° C.

In the anode compartment, 2 g of $MnSO_4.H_2O$ are dissolved in 130 g of 88% $H_2SO_4$, and, when the colourless solution has turned pale violet ($Mn^{2+} \rightarrow Mn^{3+}$) shortly after the start of the electrolysis, 5 g (0.011 mol) of 4,4'-bibenzanthrone are dissolved in the anolyte, which is at 95° C. The electrolysis is discontinued after passing 51,500 coulombs (7.5 volts, 2 amperes and 7.5 hours). The current efficiency is 70.2% of theory. The anolyte is diluted to 60% with water and the dioxoviolanthrone which has been formed is filtered off, washed until neutral and dried. Yield: 2.1 g=39.28% of theory.

Dioxoviolanthrone can be reduced in a customary manner to give dihydroxyviolanthrone.

EXAMPLE 15

46.8 g (0.225 mol) of anthraquinone are dissolved in 1,300 g of 88% sulfuric acid on the cathode side in an electrolytic apparatus equipped with a carbon cathode, a Pt anode and a clay diaphragm, and 31.05 g of glycerol are added dropwise while current is being passed.

The anode side of the electrolytic cell contains 600 g of 88% sulfuric acid, in which 80 g (0.47 mol) of $MnSO_4.H_2O$ and 0.62 g (2 mmols) of $Ag_2SO_4$ are suspended or dissolved.

51,700 coulombs are consumed in the electrolysis at 95° C. (3.5 volts, 3 amperes and 5 hours).

44 g of benzanthrone of melting point 171°-173° C. are isolated after the crude benzanthrone has been precipitated from the catholyte and sublimed. This corresponds to a product yield of 85% of theory and a current efficiency of 71%.

When the electrolysis is complete, the anolyte is treated with 25 g (0.055 mol) of 4,4'-bibenzanthrone and is stirred for 4 hours at 30° C. After the reaction mass has been diluted with 640 ml of water, the dioxoviolanthrone formed is reduced to dihydroxyviolanthrone in situ by passing in 2.24 liters (0.1 mol) of $SO_2$ at 60° C. The precipitate of dihydroxyviolanthrone is filtered off, washed and dried. Yield of dihydroxyviolanthrone: 24.1 g (0.049 mol)=90% of theory, at an overall current efficiency of 73.4%.

EXAMPLE 16

5.02 g (90% titre) of bibenzanthrone are added in the course of 1 hour to 145 ml of an anolyte containing 0.086 mol of $Mn^{3+}$, and the mixture is allowed to react for 1½ hours at 30° C. (conversion of $Mn^{3+} \rightarrow Mn^{2+}$=85%). 145 ml of water are then added to the reaction mixture, which is heated to 60° C. and 5.36 g of $SO_2$ gas, of which 0.694 g are consumed in reducing the dioxoviolanthrone formed, are passed in, while stirring, in the course of 45 minutes. The reaction mixture is heated to 90° C. for 2 hours and excess $SO_2$ is removed by blowing with nitrogen.

The reaction product is removed by filtration through a frit and the mother liquor is re-concentrated in vacuo (1 to 5 mm Hg). The reaction product is washed with water until it is neutral and is dried. Yield of dihydroxyviolanthrone: 4.85 g=90.67% of theory.

The yield of concentrated mother liquor is 116 ml, containing 198.4 g of $H_2SO_4$ and $Mn^{2+}$. The mother liquor is made up to 145 ml with 98% $H_2SO_4$ and water, and is transferred to the anode compartment and the anodic oxidation cycle is repeated.

After 5 cycles, after removing the product, the sulfuric acid containing Mn(II) is purified by adding 1 g of active charcoal, subsequently warming to 40° C. and filtering. The clarified anolyte is pale yellow again and, after re-concentration, can be used in further oxidation cycles.

The current efficiency of the re-oxidation of manganese(II) sulfate to manganese(III) sulfate is favourably affected by catalytic quantities of silver ions, and also depends on the current density and the degree of conversion.

| | Yield of Mn(III) | |
|---|---|---|
| Current density | with silver salt | without silver salt |
| 51 mA/cm² | 90% | 74% |
| 200 mA/cm² | 80% | 30% |

EXAMPLE 17

A $Ti/PbO_2$ anode is used instead of a Pt anode in the electrolytic apparatus described in Example 1. The clay diaphragm is replaced by an ion exchange membrane composed of perfluorinated polymeric hydrocarbons. The cathodic reaction and the anodic reaction take place simultaneously in the electrolytic cell.

The cathodic synthesis of benzanthrone proceeds as described in Example 1. Yield of sublimed benzanthrone: 81.5% of theory, melting point 171°-172° C.; cathodic current efficiency 68.4% of theory.

2 g of $MnSO_4.H_2O$ are dissolved in 130 g of 88% $H_2SO_4$ in the anode compartment, and, when the colourless solution has turned pale violet ($Mn^{2+} \rightarrow Mn^{3+}$), shortly after the start of the electrolysis, 2 g (0.0058 mol) of tetrachloropyrene are dissolved in the anolyte, which is at 95° C. The electrolysis is discontinued after passing 51,600 coulombs (7.0 volts, 4 amperes and 4 hours).

The anolyte is diluted with water to 50% $H_2SO_4$ and the solid residue is filtered off with suction, washed until it is neutral and dried. Yield of crude material, after drying: 2.4 g. According to mass-spectrometric analysis, this dry residue contains, as products, naphthalenetetracarboxylic acid anhydride and naphthalenetetracarboxylic acid and a little starting material, tetrachloropyrene.

EXAMPLE 18

As described in Example 1, 46.8 g of anthraquinone are added to 1,300 g of 88% $H_2SO_4$ on the cathode side in an electrolytic apparatus equipped with a carbon cathode, a Pt anode and a clay diaphragm, and, after the anthraquinone has dissolved and after applying a voltage of 3.5 volts, 31.05 g of glycerol are added dropwise.

The anode side of the electrolytic cell contains 130 g of 88% sulfuric acid, in which 10 g of $MnSO_4.H_2O$ are suspended.

51,900 coulombs are consumed in the electrolysis at 95° C. (3.5 volts, 3 amperes and 5 hours).

Yield, after working up the contents of the cathode compartment: 79.4% of theory of benzanthrone, melting point 173°-174° C. The cathodic current efficiency is 83.7% of theory.

The anolyte is treated with a portion of 14.0 g=0.04 mol of tetrachloropyrene and the mixture is stirred for 6 hours at 30° C. The product formed is diluted with 300 ml of water and is filtered off with suction, washed until it is neutral and dried.

Yield of crude material, after drying: 13.5 g.

According to mass-spectrometric analysis, the dry residue contains, as the product, naphthalenetetracarboxylic acid anhydride, together with small quantities of the starting material.

EXAMPLE 19

200 g of 90% sulfuric acid, containing 0.09 mol of Mn(III) sulfate, obtained by electrochemical oxidation of Mn(II) sulfate in accordance with Example 6, are treated at room temperature with 1.54 g (0.01 mol) of acenaphthene, while stirring, the temperature rising by 2° C. After stirring for 5 hours at room temperature, the reaction mixture is diluted to a sulfuric acid concentration of 55% and the insoluble organic residue is filtered off with suction. The material on the filter is washed with water and dried. Yield of crude substance: 1 g (after drying). Mass-spectrometric analysis shows that the dry residue contains 1,8-naphthalenedicarboxylic acid anhydride.

EXAMPLE 20

The procedure described in Example 19 is repeated, except that 1.28 g (0.01 mol) of naphthalene are used instead of acenaphthene, affording 0.5 of a dry residue in which phthalic anhydride can be detected by mass spectrometry.

EXAMPLE 21

10 g (0.03 mol) of malachite green leuco-base are oxidised as described in Example 19 by means of 0.09 mol of Mn(III) sulfate, dissolved in 200 g of 90% sulfuric acid. The solution of Mn(III) sulfate in sulfuric acid was obtained by electrochemical oxidation of Mn(II) sulfate, in accordance with Example 6. In the course of 10 minutes, the solution becomes dark and the temperature rises to 53° C. The oxidation is complete after 1.5 hours, and the 90% sulfuric acid is filtered, undiluted, through a glass frit; 54.4 g of moist $MnSO_4.N\ H_2SO_4$ are recovered in this way. The mother liquor is diluted to give 55% sulfuric acid and this solution is adjusted to pH 3 with 30% NaOH. Malachite green is precipitated in dark green, glittering crystals having the composition $C_{23}H_{25}N_2(+).(SO_4^{2-})/_2.NNa_2SO_4$. Yield of dry material: 19 g.

What is claimed is:

1. An electrochemical process for the preparation of benzanthrone and planar, polycyclic aromatic oxygen-containing compounds, which comprises carrying out the reaction in an electrolytic cell which is separated by a diaphragm into a cathode compartment and an anode compartment and which contains an acid in the cathode compartment, in which process an anthraquinone of the formula

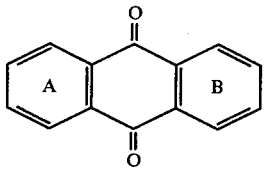

is converted electrochemically in the cathode compartment into the semiquinone form and the latter being reacted with glycerol to give the benzanthrone of the formula

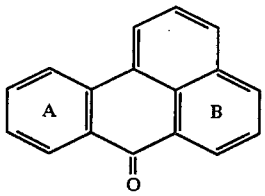

in which the benzene rings A and B can be substituted, and, in the anode compartment, the cations of a transition metal salt are simultaneously converted from a lower oxidation stage into a higher oxidation stage, the cations in their higher oxidation stage being used for the chemical oxidation of planar, polycyclic aromatic compounds to give the corresponding oxygen-containing compounds, said chemical oxidation either carried out directly in the anode compartment or subsequently in a separate reactor vessel; and isolating from the catholyte and anolyte the respective products formed.

2. A process according to claim 1, wherein the starting material used is an anthraquinone in which the rings A and B contain one or more of the following substituents, $C_1$-$C_4$ alkyl, $C_1$-$C_4$ alkoxy, hydroxyl or halogen.

3. A process according to claim 1, wherein anthraquinone is reduced cathodically to give oxanthrone, and the latter is reacted with glycerol to form benzanthrone by cyclisation.

4. A process according to claim 1, wherein 4,4'-bibenzanthrone is converted into dioxoviolanthrone by chemical oxidation in the anolyte during or after the electrolysis.

5. A process according to claim 1, wherein an electrolytic cell having a diaphragm of pore width 1 to 300$\mu$ is used.

6. A process according to claim 1, wherein mineral acids having a $pK_s<2$ are used.

7. A process according to claim 6, wherein sulfuric acid of a concentration of 60 to 98%, is used.

8. A process according to claim 1, wherein the reaction is carried out at a temperature between 50° and 150° C.

9. A process according to claim 1, wherein transition metal ions are oxidised anodically and redox pairs having a potential of +0.5 to +2.5 volts are thus obtained.

10. A process according to claim 9, wherein one of the following redox pairs is present in the anode compartment: $Mn^{2+}/Mn^{3+}$, $Ce^{3+}/Ce^{4+}$, $Co^{2+}/Co^{3+}$ or $Ag^{+}/Ag^{2+}$.

11. A process according to claim 10, wherein the anode compartment contains manganese(II) sulfate, which is oxidised during the electrolysis to give manganese(III) sulfate.

12. A process according to claim 10, wherein a mixture of two redox pairs in a molar ratio of 1:100 to 1:1,000 is present in the anode compartment.

13. A process according to claim 1, wherein the anodic oxidation is carried out in the presence of catalytic quantities of a silver(I) salt, preferably silver(I) sulfate, in a concentration of 1 to 10 mmols per mol of transition metal salt.

14. A process according to claim 1, wherein the chemical reaction is carried out by transferring the contents of the cathode compartment and of the anode compartment from the electrolytic cell into separate reactor vessels when the electrochemical redox reaction is complete.

15. A process according to claim 14, wherein the anolyte which has been consumed in the chemical oxidation reaction is purified, reconcentrated and recycled to the anode compartment of the electrolytic cell, where the transition metal ions are again oxidised electrochemically.

16. A process according to claim 1, wherein anthraquinone is cathodically reduced in 80 to 90% sulfuric acid and glycerol is added at the same time in a molar ratio of 1:1.1 to 1:2, the sulfuric acid is diluted to 60% when the reaction is complete and the precipitated benzanthrone is isolated.

17. A process according to claim 1, wherein manganese(II) sulfate is oxidised anodically in 80 to 90% sulfuric acid, in the presence of 4,4'-bibenzanthrone, to give manganese(III) sulfate, which acts in situ as an oxidising agent and converts 4,4'-bibenzanthrone into dioxoviolanthrone.

18. A process according to claim 1, wherein manganese(II) sulfate is oxidised anodically to manganese(III) sulfate in 80 to 90% sulfuric acid, the anolyte is then used in a separate reaction vessel to convert 4,4'-bibenzanthrone by oxidation into dioxoviolanthrone, and, after the product has been isolated, the anolyte is recycled to the anode compartment for reoxidation.

19. A process according to claim 1 wherein the products formed are isolated by either diluting the mineral acid electrolyte and precipitating the product, or extracting the product from the dilute acid electrolyte by means of an organic solvent.

20. A process according to claim 7, wherein sulfuric acid of a concentration of 80 to 95%, is used.

21. A process according to claim 8, wherein the reaction is carried out at a temperature between 80° to 120° C.

22. A process according to claim 8, wherein the reaction is carried out at a temperature between 90° and 105° C.

* * * * *